United States Patent [19]

Kain

[11] 4,006,569

[45] Feb. 8, 1977

[54] PANEL MOUNTING

[75] Inventor: Oscar Kain, Van Nuys, Calif.

[73] Assignee: Monarch Mirror Door Co., Inc., Van Nuys, Calif.

[22] Filed: Oct. 2, 1975

[21] Appl. No.: 619,019

[52] U.S. Cl. ..... 52/397; 52/400

[51] Int. Cl.[2] ..... E04B 1/62

[58] Field of Search ..... 52/208, 397, 398, 400; 428/34

[56] References Cited

UNITED STATES PATENTS

| | | | |
|---|---|---|---|
| 2,278,348 | 3/1942 | Dutfield et al. | 52/400 |
| 2,303,149 | 11/1942 | Verhagen | 52/399 |
| 2,631,340 | 3/1953 | Decker | 52/476 |
| 2,667,951 | 2/1954 | Gall | 52/400 X |
| 2,934,801 | 5/1960 | Blaszkowski | 52/399 |
| 3,001,248 | 9/1961 | Verhagen et al. | 52/399 X |
| 3,239,976 | 5/1966 | Hall | 52/656 X |
| 3,411,255 | 11/1968 | Casebolt | 52/397 |
| 3,514,916 | 6/1970 | Hoverman, Jr. | 52/400 |
| 3,837,130 | 9/1974 | Hildebrandt | 52/400 |
| 3,866,374 | 2/1975 | Dallen | 52/398 X |

*Primary Examiner*—Alfred C. Perham
*Attorney, Agent, or Firm*—Fulwider, Patton, Rieber, Lee & Utecht

[57] ABSTRACT

In assembling mirrors, glass panels and the like in the channel of a frame member where resilient gaskets are employed to protect the panel, the gasket is secured in the frame section by means of providing on at least one wall of the frame member an upstanding leg which is spaced from the upper portion of the wall to define a longitudinally running slot. The gasket is adapted for securement by a shoulder formed on the upper edge of the gasket wall disposed adjacent the slot and a depending flap carried by the shoulder which is received in the slot to securely lock the gasket in the channel of the frame member to prevent misalignment of the gasket during insertion of the panel in the frame member.

10 Claims, 3 Drawing Figures

PANEL MOUNTING

BACKGROUND OF THE INVENTION

The present invention relates to the mounting of panels and more particularly to an improved mounting frame member including a resilient gasket.

Glass panels, such as window glass, mirrors or the like are often mounted in metal frames comprising elongated channel members incorporating a resilient gasket in the channel to protect the edge of the panel and to aid in securing the panel in the channel member. Assembly of the frame and panel is normally accomplished by placing the resilient gasket by hand about an edge of the panel and then inserting the panel and gasket into the channel member. The dimensions of the channel member and resilient gasket are such that the panel is snugly received in the channel member. During the assembly, however, the gasket may become distorted and misaligned in relation to the panel edge and channel. Such gasket misalignment may result in undesirable stretching or compression of the gasket which is unsightly and which can adversely affect the protection of the panel edge in the channel. Normally the panel and frame must be disassembled and assembly repeated. Accordingly, a relatively high level of skill and time is required to effect the proper assembly of the panel, gasket and frame.

Efforts have been made to speed up the assembly process by prepositioning the resilient gasket in the mounting frame and then inserting the panel edge. However, with conventional gaskets and frames, the resilient gasket may still be deformed during the assembly process so that it is improperly positioned in the channel member to protect and seal the panel edge therein.

The present invention overcomes the foregoing deficiencies and permits a rapid assembly of panels in mounting frames with very few rejections.

SUMMARY OF THE INVENTION

The invention resides in a mounting frame for panels, such as mirrors, window glass and the like, in which a resilient gasket is secured in a channel member prior to insertion of the panel. The gasket is prevented from any substantial movement while the panel edge and frame are being assembled and misalignment of the resilient gasket resulting in its improper positioning in the channel member is avoided. In addition, a lower degree of skill is required and assembly time is substantially reduced with resultant savings of money and labor.

More particularly, the frame includes an elongated channel member having a base and spaced apart walls defining a channel therebetween with at least one of the walls being provided with an upwardly opening slot which extends parallel to the channel. The resilient gasket includes a base and at least one upstanding wall for insertion in the channel to provide a resilient protective liner for the panel edge portion. A transversely extending shoulder is provided on the upper edge of the wall and carries a depending flap from its lower surface which is in spaced relation to the gasket wall for insertion in the upwardly opening slot to securely lock the resilient gasket in the channel member. In this manner the resilient gasket is maintained in its proper position when the panel edge is inserted in the channel member.

In one embodiment of the invention adapted for the mounting of a mirror having a protective backing, only one wall of the channel member adjacent the unprotected mirror surface need be adapted for locking the resilient gasket. The gasket itself defines in cross section an L-shaped member having a base and one upstanding wall carrying the locking flap. In another embodiment, both walls of the channel member are adapted for locking the gasket and the gasket defines in cross section a U-shaped member having two upstanding walls, each of which carry a depending locking flap for insertion in the locking slot of the corresponding wall of the channel member.

Other features of the present invention reside in the provision of longitudinally extending serrations or grooves on the inner and outer surfaces of the locking flap and the opposed faces of the locking slot for improved securement of the flap and in the contouring of the upper surface of the transversely extending shoulder to provide an attractive molding when the panel and frame are assembled.

These and other advantages of the invention will be apparent in the following detailed description taken in conjunction with the drawings and the appended claims.

DESCRIPTION OF THE INVENTION

Figure 1:
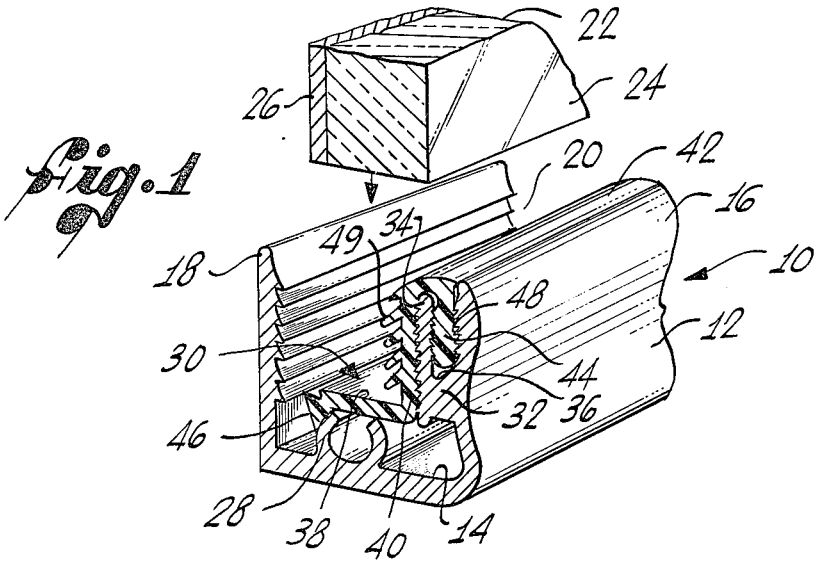
FIG. 1 is a perspective view, partially in section and partially broken away for compactness of illustration, showing a channel member and resilient gasket constructed in accordance with the present invention for a panel having a protective backing and showing a portion of such panel in alignment for insertion in the channel member.

Referring to the drawings and FIG. 1 in particular, a mounting frame, indicated generally as 10, comprises one or more sections of an elongated channel-shaped member 12 including a base 14 and spaced apart side walls 16 and 18 which define a channel or recess 20 for receiving an edge portion of a panel 22 having an exposed surface 24, such as a mirror surface, and a protective backing 26 over the opposite surface. The mounting frame 10 may extend around one or more edges of the panel 22 and for connecting sections together, a generally tube shaped member 28 is disposed along the base 14 for receiving screws or connecting pins for fastening the section ends. A resilient gasket, shown generally as 30, is provided in the recess 20 for cushioning the edge and unprotected surface 24 of the panel 22. No gasket is required between the inner surface of the wall 18 and the protective backing 26 and thus the inner surface of the wall 18 is left exposed.

Typically the gasket 30 is formed from an elastomeric resilient material such as for example rubber, polyvinyl acetate or polyvinyl chloride. The gasket, in addition to its cushioning and protective function, also serves to aid in securing the panel 22 in the frame 10.

Typically, with conventional gaskets and channels utilized for mirror frames and the like, assembly is accomplished by first placing the gasket 30 about the edge portion of the panel 22 and forcing the gasket and panel edge portion into the recess 20 of channel member 12. The transverse dimension of the gasket 30 and panel 22 is such as to insure a snug fit in the recess 20 so that the panel 22 is securely inserted in the channel member 12. However, during the assembly, the resilient gasket 30 is subjected to a certain amount of deformation which, because of the flexible nature of the gasket material, may result in misalignment of the gasket in recess 10 which may interfere with the proper seating of the channel or may result in unsightly bulges of the gasket unless care is exercised in the assembly process. Alternatively, positioning the gasket 30 in the recess 20 prior to insertion of the panel 22, which would ordinarily speed up the assembly process, may still result in misalignment of the gasket leading to the problems mentioned above.

In accordance with the present invention, the channel member 12 and the resilient gasket 30 are provided with means for cooperative inter-engagement to lock the gasket in the recess 20 of the channel member. Thus, the resilient gasket 30 can be prepositioned in the channel member 12, preferably by automatic means, and the assembly of the frame 10 about the panel 22 is substantially faster while at the same time rejection of panel-frame assemblies because of mispositioning of the gasket are substantially eliminated.

Figure 2:
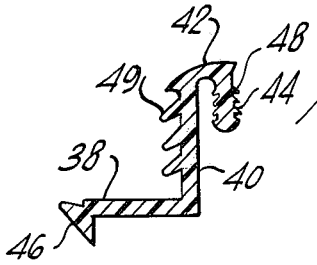
FIG. 2 is an end sectional view of the resilient gasket used in the embodiment of FIG. 1.

As is more specifically shown in FIGS. 1 and 2, a portion of the inner surface of the wall 16 intermediate its upper edge and its juncture with the base 14 is extended inwardly to define a longitudinal rib 32 carrying an elongated, upstanding leg 34 spaced from the wall 18 to define one side of the recess 20 and spaced from the wall 16 to define an upwardly opening slot 36 which longitudinally extends parallel to the recess 20 and open adjacent the upper edge of the wall 16.

The resilient gasket 30 (FIG. 2) includes a transverse web 38 and one upstanding wall 40. When the gasket is inserted in the recess 20, the web is supported by the tubular member 28 and the upstanding wall 40 overlies the inner surface of the upstanding leg 34. The upper edge of the wall 40 is transversely directed outwardly to form a shoulder 42, the extending end of which carries a depending flap 44 which is received in the slot 36. The depending flap 44 is spaced from the wall 40 for receiving therebetween the upper portion of the leg 34. The upper surface of the shoulder 42 is contoured to provide an attractive molding between the frame 10 and the panel 22 when assembled. The opposite edge of the web 38 carries a longitudinally extending rib 46 which is wedge shaped in cross section and which is adapted for insertion in the space or channel formed between the tubular member 28 and the lower portion of the wall 18. In this manner the opposite edge of the web 38 is also restrained in the recess 20.

Thus, when positioned in the channel member 12, the flap 44 is securely engaged in the slot 36 while the leg 34 is securely received between the flap and the wall 40. In this manner, the wall 40 of the resilient gasket 30 is securely locked with the wall 16 while the opposite edge of the resilient gasket is locked in the recess 20 by the rib 46. Preferably, the opposed surfaces of the slot 36, the faces of the flap 44 and the inner surfaces of the leg 34 are provided with longitudinal serrations 48. In addition deformable, longitudinal ribs 49 on the inner surface of the wall 40 resist the removal of the panel 22.

Figure 3:
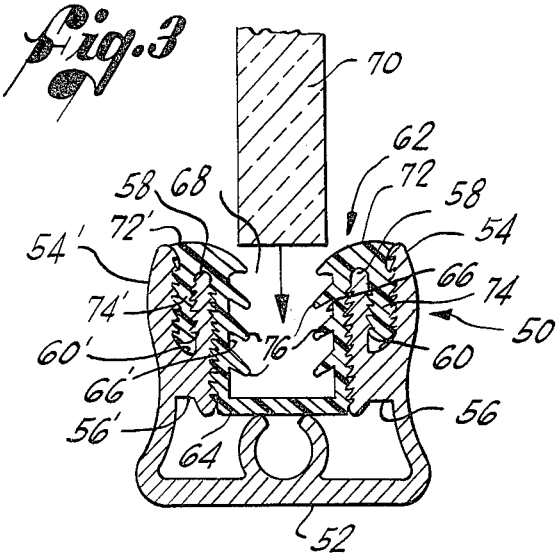
FIG. 3 is an end sectional view of another embodiment of the present invention for assembly with a panel having no protective backing and showing an edge portion of the panel, with portions cut away for compactness of illustration, in alignment with the channel for insertion.

In another embodiment (FIG. 3) a channel member, indicated generally as 50, includes a base 52 and opposed upstanding walls 54 and 54'. Portions of the opposed surfaces of the walls 54 and 54' are inwardly extended to define a longitudinal rib 56 and 56' respectively, each of which carry an upstanding leg 58 in spaced relation with the respective walls to define longitudinally extending slots 60 and 60'. A resilient gasket 62, having a web 64 and opposed side walls 66 and 66', is disposed in the channel member 50 to define a recess 68 for receiving and securing the edge portion of a panel 70. The upper edges of the walls 66 and 66' are provided with outwardly extending shoulders 72 and 72' respectively, each carrying a depending flap 74 and 74' which are received in their respective slots 60 and 60' to lock the gasket 62 in the manner described above. Deformable longitudinal ribs 76 are formed on the opposed surfaces of the side walls 66 and 66' to resist withdrawal of the panel 70 from the recess 68. Preferably, the opposed surfaces of the slots 60 and 60', the faces of the flaps 74 and 74' and the opposed inner surfaces of the legs 58 are provided with longitudinal serrations for improved locking of the gasket 62 in the channel member 50.

While the invention has been described in connection with several specific embodiments, it will be clear that modifications and changes can be made without departing from the spirit and scope of the invention as defined by the appended claims.

I claim:

1. A channel and a gasket assembly for mounting an edge portion of a panel comprising:

a channel member having an elongated supporting base and an upstanding wall extending longitudinally along one edge of said base and defining a recess therewith for receiving an edge portion of a panel; and a resilient gasket adapted to be received in said recess to provide a protective surface therein, said gasket having a web and an upstanding side wall to conform with said recess, said gasket side wall carrying a flap;

said channel member further having means forming a longitudinal slot intermediate the upper edge of said upstanding wall and the juncture with said base, said slot opening adjacent to and parallel with the upper edge of said upstanding wall, whereby said flap of said resilient gasket is fully inserted into said slot in a continuous and coextensive engagement therewith to firmly secure said resilient gasket in said channel member.

2. The assembly of claim 1 wherein the upper edge of said side wall of said gasket defines a transversely extending shoulder and said flap is carried from the extending edge of said shoulder in spaced relation to said side wall for alignment with said slot and for receiving a portion of said means forming said slot in the space between said said flap and the outer surface of said side wall of said gasket.

3. The assembly of claim 1 wherein said channel member further includes a second upstanding wall extending along the opposite edge of said base and means forming a longitudinal channel extending along the juncture of said wall and said base; and a longitudinal rib formed adjacent the edge of the web of said gasket opposite the side wall, said rib being received in said longitudinal channel for securement of the edge of said gasket opposite the side wall.

4. The assembly of claim 3 wherein said means forming said longitudinal channel includes an elongated tubular member axially aligned with the longitudinal axis of the base of said channel member and extending parallel thereto, the upper surface of said tubular member supporting the web of said resilient gasket and the inner surface of said second wall and the side surface of said tubular member defining said channel.

5. The assembly of claim 1 wherein said channel member further includes a second upstanding wall and means forming said longitudinal slot therealong; and said resilient gasket includes said web and an opposed pair of side walls, each of said side walls carrying a flap for being received in the slot of the respective upstanding walls of said channel member.

6. A mounting frame for panels comprising:

at least one elongated channel member having a base and spaced apart upstanding walls defining a channel therebetween, the inner face of at least one of said walls intermediate the juncture of said base therewith and the upper edge of said wall being inwardly directed to define a longitudinal rib running along the inner face of the wall, said rib carrying on its inner edge an upstanding leg in spaced relation with said wall to define an upwardly opening slot extending parallel with said channel, said leg being spaced from the opposing wall of said channel member to define therebetween a recess for receiving the edge portion of a panel; and a resilient gasket having a web and side wall for being received in said recess to provide resilient surfaces for said base and said inner face of said leg, the upper edge of said gasket side wall having an outwardly directed shoulder and a depending flap carried along the extending edge of said shoulder, said flap being spaced from said side wall for being received in a continuous and coextensive engagement with said slot and for receiving the upper portion of said leg between the flap and the outer surface of said side wall;

said channel member further having longitudinal serrations on the opposed inner surfaces of said slot and said resilient gasket further having longitudinal serrations on the inner surface of said sidewall and the faces of said flap, thereby to securely lock said gasket in said channel member.

7. The frame of claim 6 further including a longitudinal tubular member carried by said base in said channel, said tubular member being spaced intermediate said upstanding walls, said resilient gasket including a longitudinal rib along the web edge opposite the side wall, said rib being received in a space defined between said tubular member and said wall of said channel member opposite said upstanding leg thereby to secure the web edge in said channel member.

8. The frame of claim 6 wherein each of said upstanding walls are provided with said rib and said upstanding leg to form said upwardly opening slot, the opposing inner surfaces of said legs being spaced apart to define therebetween said recess for receiving the edge portion of a panel, said resilient gasket including said web and spaced side walls for being received in said recess with said web overlying said base and the outer surfaces of the side walls contiguous with the inner surfaces of the respective legs, the upper edge of each of the gasket side walls having said outwardly directed shoulder carrying said depending flap, said depending flap along each side of said gasket being received in a corresponding one of said slots for securing said gasket in said channel member.

9. The frame of claim 6 wherein the upper surface of said outwardly directed shoulder is contoured to provide a molding between the channel member and the panel when the panel edge portion is received in said recess.

10. A channel and a gasket assembly for mounting an edge portion of a panel comprising:

a channel member having an elongated supporting base and an upstanding wall extending longitudinally along one edge of said base and defining a recess therewith for receiving an edge portion of a panel;

said channel member further having a longitudinal slot defined by an inner face of said upstanding wall, and a longitudinal rib running intermediate the upper edge and the juncture with said base along the inner face of said upstanding wall, said rib carrying on its inner edge an upstanding leg parallel to and in spaced relation with said upstanding wall of said channel member, said longitudinal slot opening adjacent the upper edge of said upstanding wall and extending parallel to said recess; and an integral resilient gasket adapted to be received in said recess to provide a protective surface therein, said gasket having a web and upstanding side wall to conform with said recess, said gasket side wall carrying a flap for being received in a continuous and coextensive engagement with said upstanding leg of said slot whereby said gasket is firmly secured in said recess.

* * * * *